United States Patent [19]

Prueitt

[11] 4,449,256

[45] May 22, 1984

[54] LEG EXTENSION JUMPERS

[76] Inventor: Melvin L. Prueitt, 161 Cascabel, Los Alamos, N. Mex. 87544

[21] Appl. No.: 237,282

[22] Filed: Feb. 23, 1981

[51] Int. Cl.[3] ..... A61F 3/00

[52] U.S. Cl. ..... 3/4; 36/7.8; 272/70.1; 272/114

[58] Field of Search ..... 272/70, 114, 70.1, 70.2, 272/119, DIG. 4; 3/4, 5; 36/7.8, 113, 114, 115, 116, 81; D21/72, 66, 67

[56] References Cited

U.S. PATENT DOCUMENTS

| | | | |
|---|---|---|---|
| 406,328 | 7/1889 | Yagn | 3/4 X |
| 822,448 | 6/1906 | Hanson | 3/5 X |
| 2,783,997 | 3/1957 | Gaffney et al. | 272/114 |
| 2,802,217 | 8/1957 | Wilhoyte | 36/7.8 X |
| 3,058,120 | 10/1962 | Smith et al. | 272/70.1 X |
| 3,102,272 | 9/1963 | Emmert | 3/4 |
| 3,110,492 | 11/1963 | Hoffmeister | 272/70.2 |
| 3,346,882 | 10/1967 | Wilhoyte | 3/4 |
| 3,902,199 | 9/1975 | Emmert | 3/4 |

FOREIGN PATENT DOCUMENTS

| | | | |
|---|---|---|---|
| 353119 | 12/1920 | Fed. Rep. of Germany | 272/70.1 |
| 476134 | 4/1928 | Fed. Rep. of Germany | 272/70.1 |

*Primary Examiner*—Robert A. Hafer
*Assistant Examiner*—Arnold W. Kramer
*Attorney, Agent, or Firm*—Paul D. Gaetjens

[57] ABSTRACT

A unique arrangement for leg extension jumpers consists of elastic members connecting movable extension tubes to guide tubes located at the front and rear of a foot platform. The foot platform is pivotally connected at its front to the front guide tube or tubes and at its rear to a support tube or tubes fixed to and extending above the rear guide tube or tubes. A leg strap is fixed to the top of the support tube or tubes. In one modification, a brace member pivoted to and extending between the lower ends of the front and rear extension tubes acts as a ground engaging member. In another modification, the brace member is pivoted to and extends between the bottom of the front guide tube and support tube. The pivoted structure forms a pivoted parallelogram which is normally held in rectangular configuration by the elastic members.

3 Claims, 6 Drawing Figures

LEG EXTENSION JUMPERS

BACKGROUND OF THE INVENTION

1. Field of the Invention

The invention relates to jumping equipment in the field of entertainment, sports and leisure activities. Jumpers are devices that may be strapped to the legs and feet to allow easy running and/or jumping. Some of the problems of previous devices were a rigid base that required the wearer to move continuously and did not allow a natural foot and leg movement which was devoid of stiffness, thus making running difficult and fatiguing the wearer.

2. Objects of the Invention

It is an object of this invention to provide a device that facilitates jumping, walking and running in long, easy strides, and excellent maneuvering.

Another object of this invention is to provide heel and toe control between the wearer's foot and the ground.

Another object of this invention is an elastic system that conserves energy, is lightweight, allows control and stability.

Other objects, advantages, and novel features of this invention will be apparent to those of ordinary skill in the art upon examination of the following detailed description of a preferred embodiment of the invention and the accompanying drawings.

3. Prior Art

A. U.S. Pat. No. 2,802,217 by Wilhoyte shows a leg extension device with a horizontal elongated base comparative in size with the foot pad and base, and capable of being articulated by means of pivots so as to impart natural foot and leg movement. This device is used in place of a stool or ladder.

B. U.S. Pat. No. 1,575,847 by King et al. discloses a plunger and spring arrangement attached to a foot rest or pedal which permits a "pogo like" jumping motion.

C. U.S. Pat. No. 3,065,962 by Hoffmeister teaches the use of a rubber elastic as a compression spring with a tube and rod arrangement that allows essentially a vertical (up and down) movement to the wearer. None of the patents provide satisfactory control and stability in both running and jumping. The device of this invention has a novel elastic arrangement that allows the foot platform to apply force to the front or back of the base. This critical feature allows toe action by the wearer similar to the motion of a trampoline jumper who uses his toes to control his actions and height of his jumps. To further aid running and maneuvering, poles similar to ski poles may be used.

SUMMARY OF THE INVENTION

A jumping and running device worn on each foot and having elastic bands, one or more elastic bands being attached to extension and guide tubes located at the extremity of a foot platform so as to allow energy to be stored in the downward motion and released in the upward motion of the platform. The foot is strapped to the foot platform and another strap just below the knee is connected to the top of a support tube to secure the leg. Elastic bands are connected near the top of extension tubes and at the bottom to guide tubes, thereby allowing the extension tube to slide therein. The foot platform is connected by means of pivots to the front guide tubes and at the rear to support tubes. Poles similar to ski poles may be used to give added maneuvering capability.

DESCRIPTION OF THE PREFERRED EMBODIMENT

Figure 1:
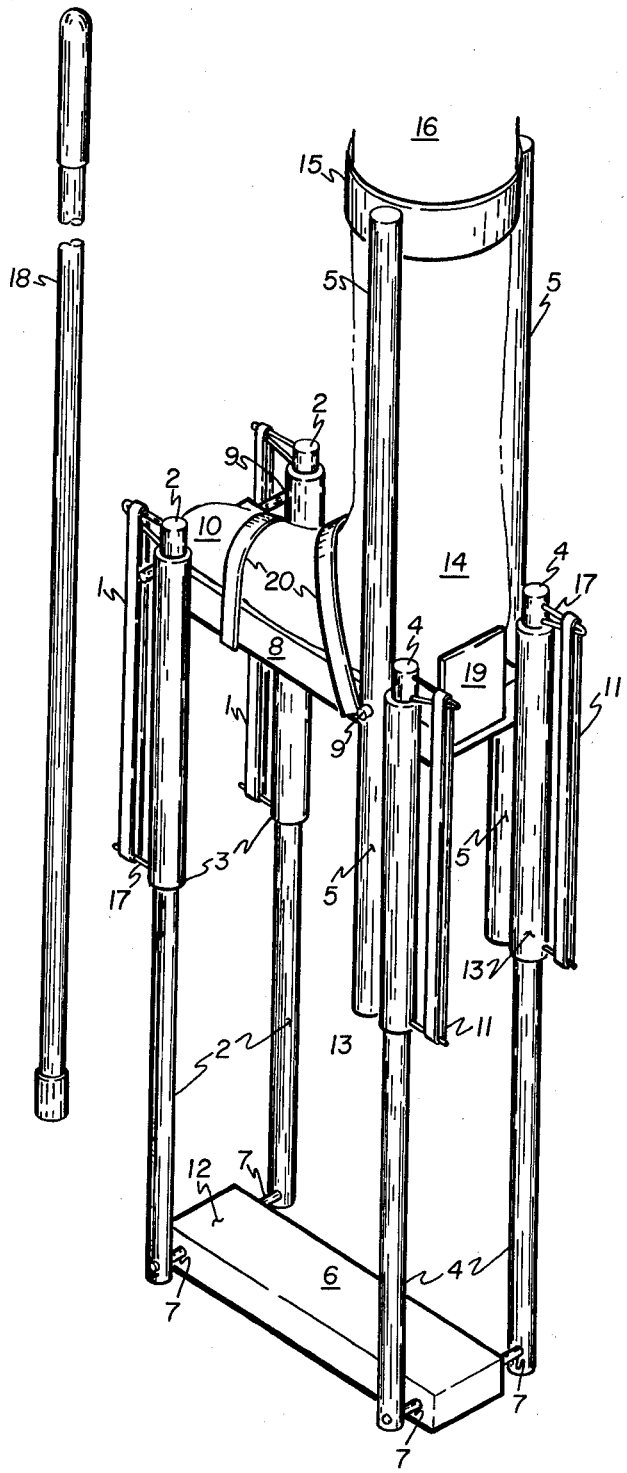
FIG. 1 shows a perspective view of the preferred embodiment of this invention.

FIG. 1 shows one jumper with pole 18, although two jumpers and two poles would be used normally. Elastic bands, 1, 11 (such as rubber cords) exert downward force on extension tubes 2, 4 which slide through guide tubes 3, 13 and connect to the base 6 by means of pivots 7. Likewise the foot support 8 is connected to the front guide tubes 3 and the support tubes 5 by pivots 9. When the toe 10 is pressed downward, force through the front elastic bands 1 causes increased force on the front 12 of the base 6. The base 6 is approximately as long as the foot platform 8. The pivots 9 that connect the platform 8 to support tubes 5 are located directly under the ankle 14 which allows toe 10 to move vertically without leg strap 15 sliding up and down on leg 16. Most of the body weight is placed on back extension tubes 4. Therefore the front extension tubes may be of lighter material, or alternatively, only one extension tube and guide tube may be needed at the front. Straps 20 secure the foot to platform 8 while hangers 17 hold the elastic bands 1, 11 between the extension tubes 2, 4 and guide tubes 3, 13. Heel plate 19 keeps the heel of the foot from sliding.

Figure 2:
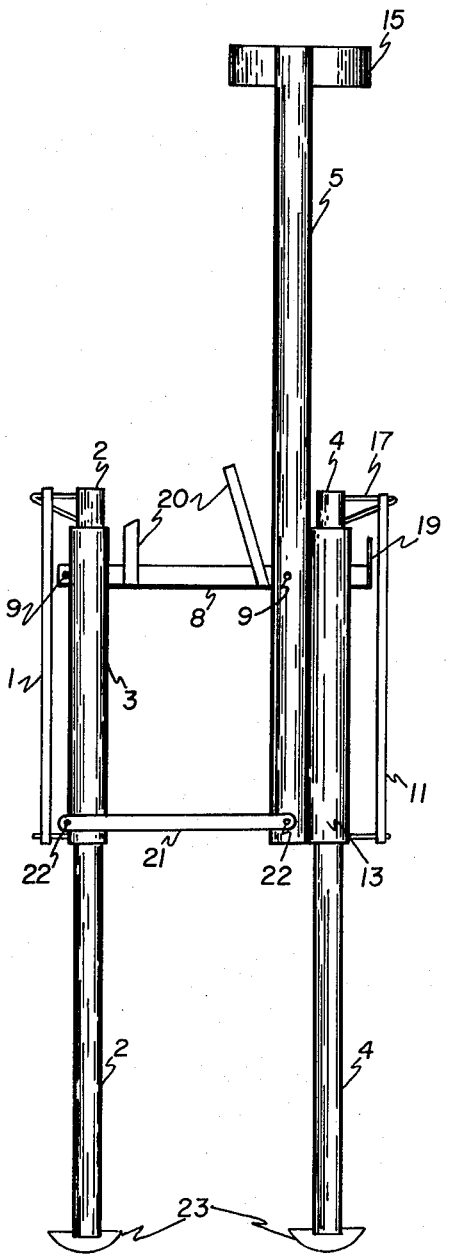
FIG. 2 is a side elevational view of another embodiment of this invention having only one set of extension and guide tubes.
Figure 3:
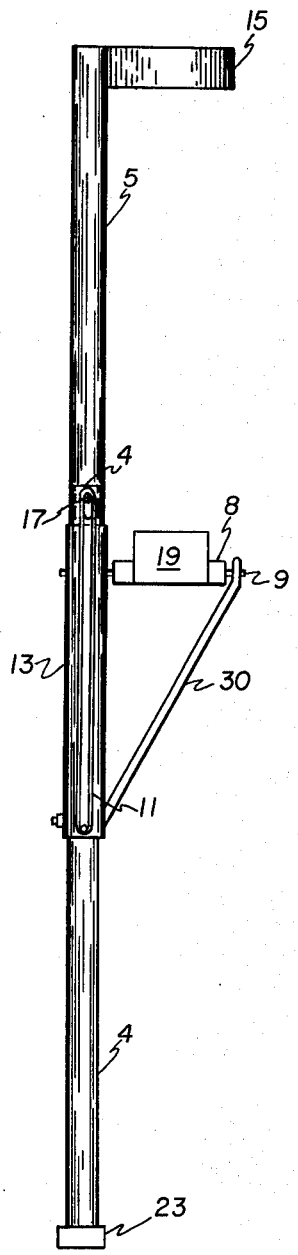
FIG. 3 is a back elevational view of FIG. 2.

FIGS. 2 and 3 show a side and back view of a lighter weight jumper using the principles of this invention, and in particular, extension tubes 2, 4 and guide tubes 3, 13 are placed only on the outside of the foot. Brace 21 is connected by means of pivots 22 to guide tube 3 and support tube 5 to keep guide tubes 3, 13 parallel. The foot platform 8 needs to be quite rigid so that front 2 and back 4 extension tubes will not twist out of alignment. Leg strap 15 is constructed of rigid material with a pad half-way around the leg with the other half being a flexible belt. The feet 23 are rounded to provide a rolling action during running or walking. As in FIG. 1, hangers 17 hold the elastic bands 1, 11 between extension tubes 2, 4 and guide tubes 3, 13 respectively, pivots 9 connect the foot platform 8 including straps 20 and heel plate 19 to guide tube 3 and support tube 5. FIG. 3 shows an angle brace 30 that further supports the foot platform 8 and is secured by means of pivot 9.

Figure 4:
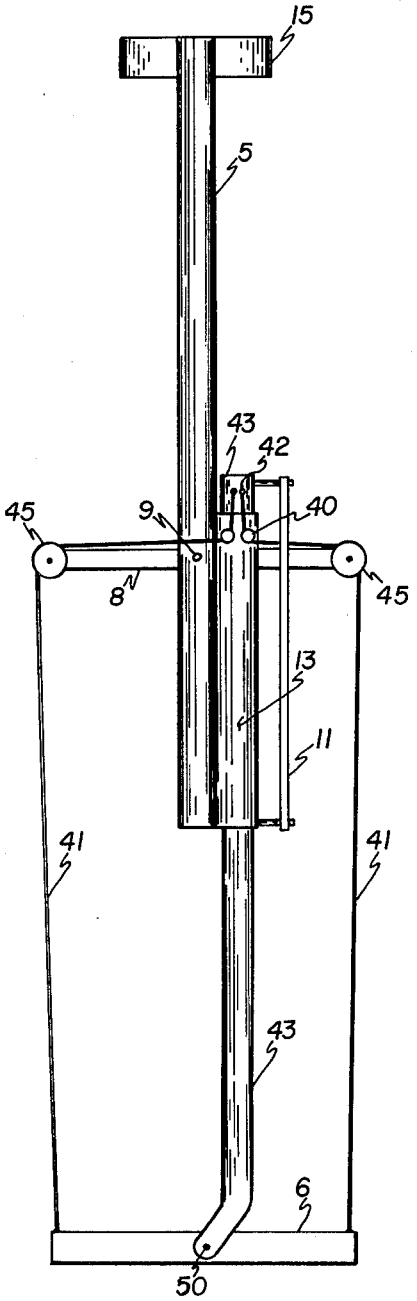
FIG. 4 is a side elevational view of this invention using multiple pulleys and cords to maintain the foot platform parallel to the base.

FIG. 4 is a side view of another embodiment of this invention wherein pulleys 40, 45 and cords 41 are connected to the extremities of base 6 and to extension tube 43 by pins 42. In addition, extension tube 43 is connected to base 6 by means of pivot 50. Platform 8 is secured to support tube 5 by pivot 9. An elastic band 11 is secured to extension tube 43 and guide tube 13 as in FIG. 1. The cords 41 keep base 6 parallel to the foot platform 8. As the platform 8 is tilted, the cords 41, in conjunction with pulleys 40, 45, force the base 6 to tilt correspondingly. The guide and extension tubes 13, 43 must be square in cross section so as to avoid twisting by the base 6. In the alternative, a second guide and extension tubes 13, 43 may be positioned on the opposite side of foot platform 8.

Figure 5:
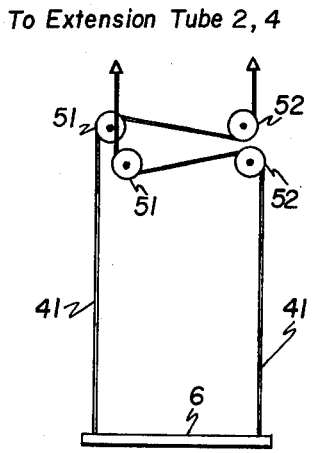
FIG. 5 is a simplified view of the pulley arrangement of FIG. 4.

FIG. 5 shows a simplified arrangement of cords 41 and pulleys 51, 52 which can be used with the embodiment of FIG. 1 to keep parallel the base 6 and platform 8. The pulleys 52 are attached to the back of platform 8 while pulleys 51 are secured to the front of platform 8. Actually, the two front pulleys and the two back pulleys may be on the same shaft but are separated in the drawings for clarity. The top ends of the cords 41 are attached to the top of the extension tubes 2 and 4. This cord 41 pulley 51, 52 arrangement could be used with the jumper shown in FIGS. 2 and 3, but the bottom ends of the cords would be attached to the feet 23 rather than the base 6.

Figure 6:
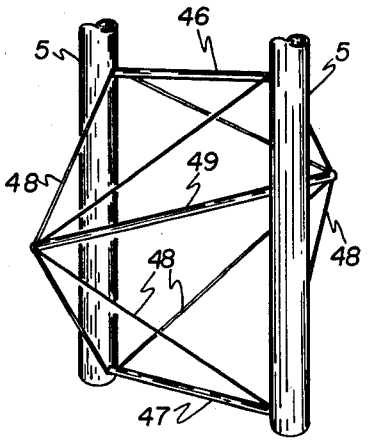
FIG. 6 is a perspective view of a support system to hold rigid the support tubes of FIG. 1.

FIG. 6 shows a unique lightweight means for preventing the support tubes 5 from twisting with respect to each other when torque is applied. Rigid connecting rods 46, 47 separate the support tubes in FIG. 1. Strong wires 48 are connected to a third rod 49 and to upper rod 46 and lower rod 47 so that four equal triangles are formed by rods 46, 47 and wire 48. This system of rods 46, 47, 49 and guide wires 48 make the support tubes 5 rigid against all twists and torques. It is placed under the foot platform 8.

OPERATION OF THE JUMPERS

In jumping, when the base 6 or feet 23 strike the ground, the extension tubes 2, 4, 43 slide upward into the guide tubes 3, 13 causing the elastic bands 1, 11 to be stretched. On rebound, the elastic bands 1, 11 force the extension tubes 2, 4, 43 to slide downward through the guide tubes 3, 13. The base 6 or feet 23 tend to stay parallel to the foot platform 8 so that as the wearer tilts his toe 10 or heel, the base 6 or feet 23 tend to tilt correspondingly. This gives the jumper extra control and allows "toe action" while keeping the knees rigid to maintain jumping energy. The distance between pivots 7 (front to back) should be approximately equal to the distance between pivots 9 (front to back). The elastic bands 1, 11 are attached to hangers 17 which allow easy replacement of the bands or the addition of more bands when the jumpers are used by a heavier person. For example, this feature makes it easy to adjust the tension on the extension tubes 2, 4 for people of different weight or jumping characteristics. The top of the extension tubes 2, 4 are attached to the elastic bands 1, 11 at a point considerably below the top of the support tubes 5 so that as the extension tubes 2, 4 move upward relative to the leg 16, the top of the extension tubes 2, 4 need not go above the top of the support tubes 5. The rear extension tube 4 of FIGS. 2, 3 or tubes 4 of FIG. 1 move or slide through guide tube 13 which further acts as a limiting device or stop for the vertical movement of base 6. That is, the base 6 can not move further than the bottom of guide tube 13. The poles 18 (two are used) help in maneuvering, maintaining balance, and making it easy for the wearer to run or jump The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. For example, the extension tube 4 can slide within the support tube 5 by having a slot cut in the support tube 5 for movement of the clip 17 holding the elastic band 11, thus eliminating guide tube 13. It is intended that the scope of the invention be defined by the claims appended hereto.

What is claimed is:

1. A leg extension jumper device controlled by toe and heel action comprising in combination:

(a) vertical front and rear guide tube means, (b) an extension tube extending through each guide tube means, (c) elastic means connecting the top portion of each extension tube and the bottom portion of its respective guide tube means, (d) support tube means fixed to and extending above the level of the rear guide tube means, (e) a leg strap fixed to the top of said support tube means, (f) foot platform means pivotally connected at its front near the top of said front guide tube means and near its rear to the support tube means with the rear pivot being located directly under the ankle of a user, (g) foot means associated with the bottoms of the front and rear extension tubes; and brace means pivotally connecting either the lower portions of the front and rear extension tube means, or the lower portion of the front guide tube means and the support tube means which, together with the foot platform means, creates a substantially pivoted parallelogram which is biased towards a rectangle by the elastic means.

2. The leg extension device of claim 1 wherein the front and rear guide tube means comprise two laterally spaced front guide tubes and two laterally spaced rear guide tubes; the support tube means comprises two support tubes, one each fixed to its respective guide tube; with the foot platform means positioned between the front and rear guide tubes and support tubes; and where the foot means and brace means together comprise a base pivotally connected to and extending between the bottoms of the two front and two rear extension tubes.

3. The leg extension jumper device of claim 1 wherein the front and rear guide tube means each comprise a guide tube; the support tube means comprises one support tube; with the foot platform means being pivotally connected at its front to the side of the front guide tube and at its rear to the side of the support tube; wherein the foot means comprises a foot on the lower end of each respective extension tube; and wherein the brace means comprises a brace pivotally connecting the lower portion of the front guide tube and the support tube.

* * * * *